United States Patent [19]

Kaufmann et al.

[11] 4,062,158

[45] Dec. 13, 1977

[54] PREFABRICATED SWIMMING POOL CONSTRUCTION

[75] Inventors: Herbert O. Kaufmann, Kew Gardens, N.Y.; John I. Schaeffer, Towaco, N.J.

[73] Assignee: Swim 'n Play, Inc., Newark, N.J.

[21] Appl. No.: 704,691

[22] Filed: July 12, 1976

[51] Int. Cl.[2] ..... E04B 1/346

[52] U.S. Cl. ..... 52/71; 52/169.1; 52/300; 4/172.19

[58] Field of Search ..... 52/169, 71, 300; 4/172.19

[56] References Cited

U.S. PATENT DOCUMENTS

| | | | |
|---|---|---|---|
| 3,268,917 | 8/1966 | Diemond et al. | 4/172.19 |
| 3,745,593 | 7/1973 | Wall | 4/172.19 |
| 3,874,132 | 4/1975 | Mendelow et al. | 52/71 |

*Primary Examiner*—Price C. Faw, Jr.
*Assistant Examiner*—Carl D. Friedman
*Attorney, Agent, or Firm*—Hopgood, Calimafde, Kalil, Blaustein & Lieberman

[57] ABSTRACT

A prefabricated swimming pool includes a liner and a wall supported by vertical posts. Lip members are arranged between the posts along the top edge of the wall and connected to the posts by brackets. The angles at which the lip members are attached to the posts are adjustable so that the number of posts used to support the wall can be varied, and pools of differing sizes can be constructed using standard components.

3 Claims, 2 Drawing Figures

PREFABRICATED SWIMMING POOL CONSTRUCTION

BACKGROUND OF THE INVENTION

The present invention relates to swimming pools, and more particularly to above-ground prefabricated swimming pools in which common components can be used to construct pools of different sizes.

In the design and construction of prefabricated above-ground pools, the cost of fabricating standard components is a major consideration. It is necessary to provide pools of a variety of sizes to accommodate the available space and the diverse desires of consumers, and the variety of components necessary for the construction of such pools is thus very large. Accordingly, the cost of manufacturing the prefabricated pool components is increased because production runs are shorter. Additionally, distributors and retailers of pools must carry large inventories, a problem which is particularly acute in areas where the sale of pools is highly seasonal.

According to known swimming pool constructions, a cylindrical wall is supported by vertical posts spaced about its periphery. A series of lip members are arranged end-to-end about the top of the wall and supported by the posts. It is conventional to attach the lip members to the posts with connecting hardware that fixes the angle formed by adjacent lip members. This angle is a function of the number of posts used in the pool. Thus each successive size of pool generally requires the prefabrication of different structural components such as lip members, posts and connecting hardware so that the number of posts can be increased. Alternatively, if the same number of posts is used as the pool size is increased, the strength of the posts must be increased with the pool size, and the length of the lip member must be varied.

SUMMARY OF THE INVENTION

The present invention is an above-ground prefabricated swimming pool construction that permits many common components to be used in pools of various sizes. The pool includes a conventional liner and wall. The wall is supported by posts that are spaced apart by a fixed predetermined distance regardless of the size of the pool. Thus pool size is increased by increasing the number of such posts arranged in a circle. Lip members of a predetermined length are arranged between the posts along the top edge of the wall. As pool size is increased, the number of lip members is increased along with the number of posts. The posts and lip members of different sized pools are interchangeable.

The ends of the lip members are connected to the top ends of the posts by brackets. Although the angle at which lip members are connected to the posts depends upon the size of the pool constructed, the brackets too are interchangeable between different sizes of pool because they permit adjustment of this angle.

According to an embodiment of the invention disclosed below, each lip member is joined at each end to a bracket by first and second fasteners. The first fastener permits only pivotal adjustment, while the second fastener permits both pivotal and sliding adjustment.

BRIEF DESCRIPTION OF THE INVENTION

For a complete description of the invention, reference may be had to the detailed description which follows and to the accompanying drawings wherein:

FIG. 1 is a three-dimensional pictorial view of a swimming pool constructed in accordance with the invention; and FIG. 2 is an exploded three-dimensional view of a post and adjoining structure of the pool of FIG. 1.

DESCRIPTION OF THE PREFERRED EMBODIMENT

Figure 1:
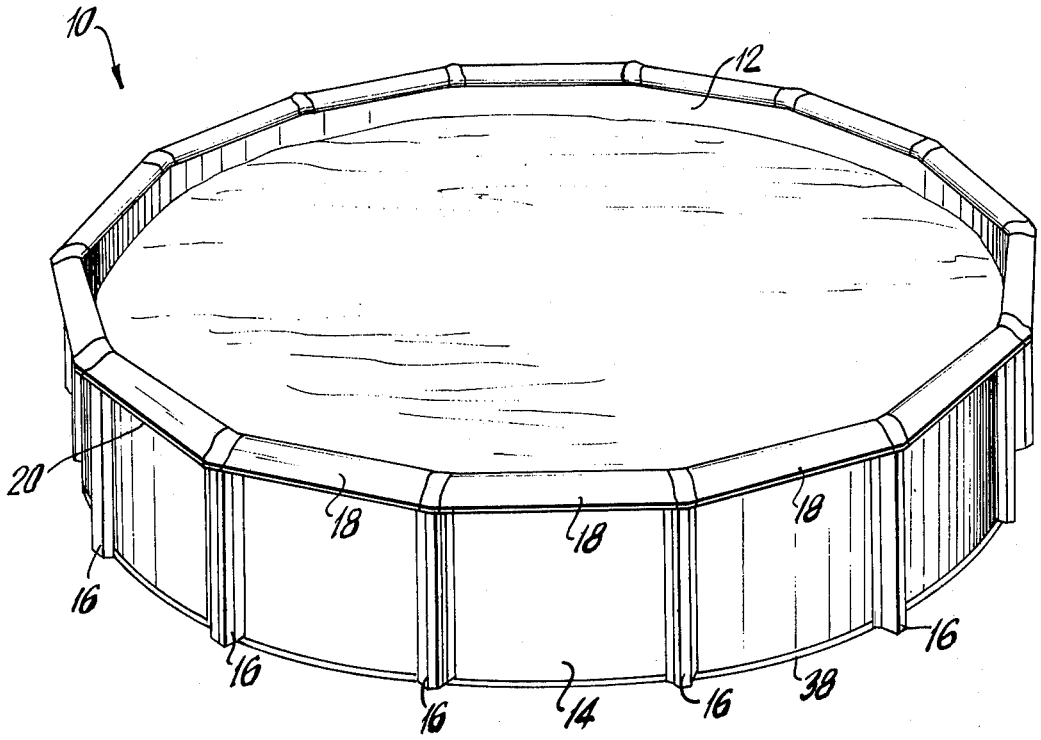

FIG. 1 shows a prefabricated above-ground swimming pool 10 constructed in accordance with the present invention. The pool 10 includes a liner 12 formed by a flexible vinyl plastic sheet disposed within an upstanding cylindrical wall 14 erected in the conventional manner by bending a single flexible sheet (preferably of aluminum) and joining the ends in the conventional manner to form the perimeter of the pool. The hydraulic pressure of the pool is exerted radially outward against the aluminum wall 14.

A plurality of evenly spaced extruded preferably aluminum posts 16 support and position the wall 14. A plurality of elongated lip members 18 are disposed between successive posts 16 along the top edge of the wall 14. Each lip member 18 is wide enough to accommodate the curvature of the arc of the wall 14 that it subtends. The substantial width of the lip members 18 also provides a convenient ledge that may be covered with slip resistant paint. Like the posts 16, the lip members 18 are made preferably of extruded aluminum.

Figure 2:
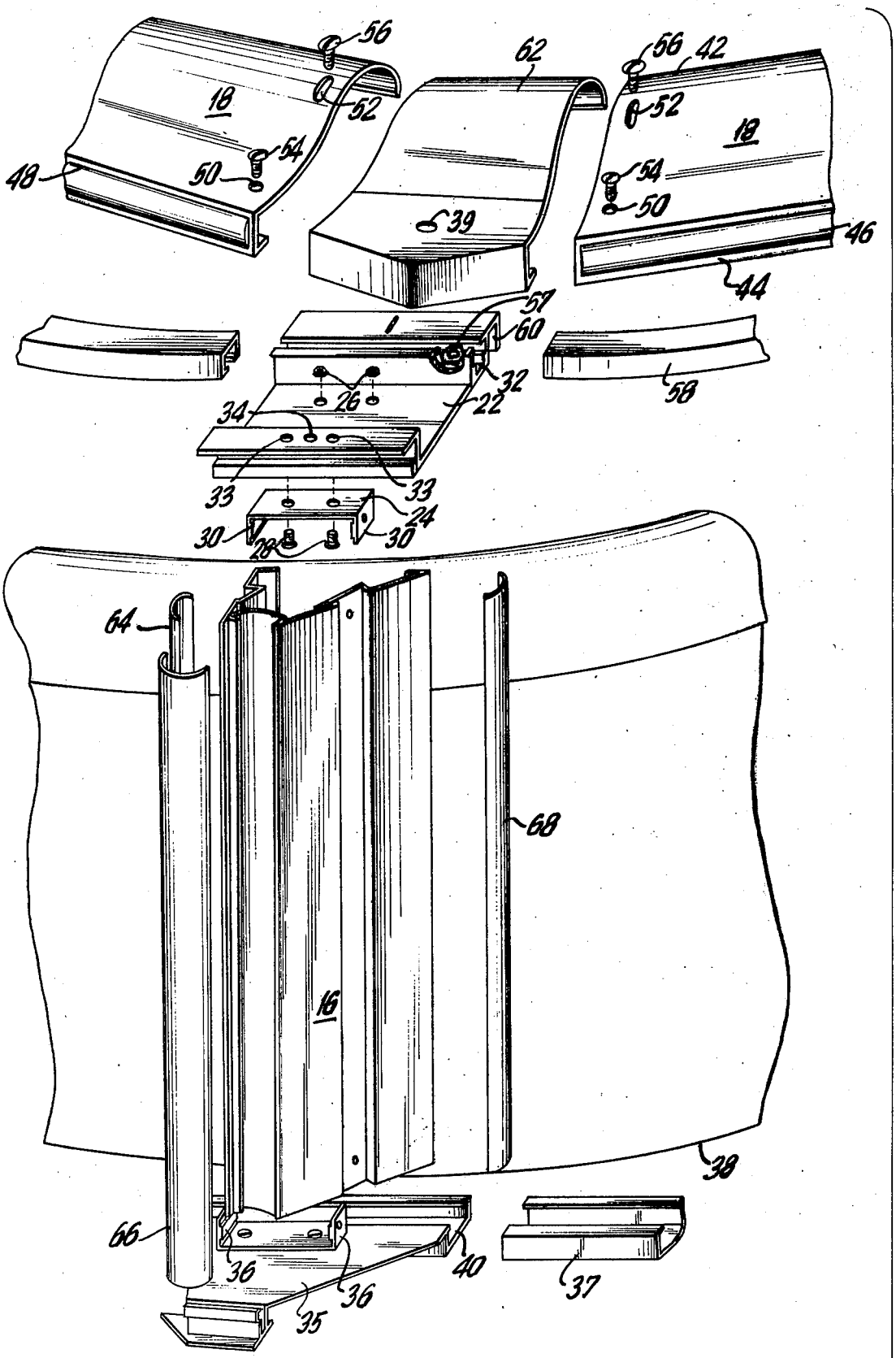

Further details of the structure of pool 10 can be observed in FIG. 2. A bracket 22, preferably of extruded aluminum, includes a U-shaped member 24 attached by nuts 26 and bolts 28 to provide two downwardly projecting lugs 30. The bracket 22 also includes a fastener-receiving channel 32 that is generally parallel to the top edge 20 of the wall 14. The bracket 22 is further provided with a pair of circular openings 33 as well as a central opening 34.

The lugs 30 are used to attach the bracket 22 to the top end of the corresponding post 16. One bracket 22 is provided for each post 16.

A bottom plate 35 carries two upstanding lugs 36 by which it is attached to the foot of the post 16 to form a base. A bottom rail 37, which engages the bottom edge 38 of the wall 14 is received by a channel 40 formed in the bottom plate 35. Each lip member 18 has a three-dimensional contour that provides a rolled under hook-shaped inner edge 42 and a downwardly projecting outer edge 44. A decorative colored plastic strip 46 is received in a channel 48 formed along the outer edge 44.

Each end of each lip member 18 is provided with a circular opening 50 and a generally radially oblong opening 52. A first fastener bolt 54 is inserted through the circular opening 50 of the lip member 18 and through one of the circular openings 33 of the bracket 22 to provide a first pivot point of connection (it is nut-engaged below bracket 22). The lip member 18 is thus limited to pivotal adjustment about the first fastener 54. A second fastener bolt 56 is inserted through the oblong opening 52 of the lip member 18 and engages nut 57 (shown in the breakaway) for sliding movement in the receiving channel 32 of the bracket 22 to provide a second point of connection. Since the second fastener bolt 56 can slide radially within the oblong opening 52 and the nut 57 can slide circumferentially within receiving channel 32, the lip member 18 is capable of sliding as well as pivotally adjusting about the second connection point. Thus each lip member end cooperates with bracket 22 and two fasteners 54 and 56 to form a means for connecting the end of the lip member 18 to a post 16 at an angle which is adjustable to allow for variation in the number of posts 16 (and hence angle) used in the construction of a particular pool.

A top rail 58 engages the top edge of the wall 14 beneath the lip member to provide rigidity and is received by a slot 60 formed along the radially inward edge of each bracket 22. A bracket cover 62, which blends the profiles of adjacent lip members 18, is secured over the top of each bracket 22 utilizing the central openings 39 and 34 for attachment. Three colored decorative plastic strips 64, 66 and 68 are held within vertical channels on the exterior surface of each post 16, and two such strips 64 and 68 cover the connection points of the bracket 22 and the bottom plate 35 to the post.

A unique feature of the pool construction described here is the adjustability of the angular position of the lip members 18 with respect to the posts 16. Since this angle can be varied, pools of various diameters can be constructed utilizing posts 16, lip members 18 and brackets 22 of standard dimensions. No modification, cutting or drilling of any of these components is necessary. The pool can be increased in size by simply inserting additional posts 16 and lip members 18 to enlarge the circle thus formed.

It will be obvious to those skilled in the art that the embodiment described above is intended to be merely exemplary and is susceptible of modification and variation without departing from the spirit and scope of the invention. For example, in the bracket 22 described here, the pair of circular openings 33 are disposed on the outside of the bracket 22 and the fastener receiving channel 32 is disposed on the inside. It would be possible to place the openings 33 on the inside and the channel 32 on the outside. It is also possible to vary the circular holes 50 by oblongation either radially or circumferentionally to provide even greater flexibility. Accordingly, the invention is not deemed to be limited except as defined by the appended claims.

What is claimed is:

1. A prefabricated above-ground swimming pool comprising a liner formed by a flexible sheet, an upstanding wall, a plurality of vertical posts supporting and positioning said wall, a plurality of elongated two-ended lip members positioned between the top ends of said posts, and a connecting the ends of said lip members to said posts at adjustable angles, said attachment means including a plurality of brackets secured respectively to the upper ends of said posts, a first fastener passing through a first opening in said lip member for joining one end of one of said lip members to one of said brackets at a first point of connection and permitting pivotal adjustment of said lip member relative to said bracket at said first point of connection, and a second fastener passing through a second oblong opening in said lip member and spaced from said first member, said second oblong opening extending longitudinally along an axis colinear with an imaginary line extending between said first opening and said second opening, said second fastener being received for sliding motion in said bracket along a path substantially perpendicular to said axis and being effective to join said lip member end to said bracket at a second point of connection spaced from said first point of connection, thereby permitting pivotal and sliding adjustment of said lip member relative to said bracket at said second point of connection.

2. A prefabricated above-ground swimming pool comprising:

a liner formed by a flexible sheet;

an upstanding wall;

a plurality of posts supporting and positioning said wall;

a plurality of brackets, each bracket having means for attachment to the top end of a post and including a pair of circular openings, and a fastener receiving channel;

a plurality of elongated two-ended lip members each horizontally disposed between successive posts along the top edge of said wall, each lip member end having a first opening aligned with a circular opening of a bracket and a generally radially oblong opening aligned with said fastener receiving channel;

a plurality of first fasteners inserted through said circular openings in said lip members and said brackets thereby permitting only pivotal adjustment of said lip members relative to said brackets about said first fasteners; and a plurality of second fasteners inserted through said oblong openings and engaging said fastener receiving channels thereby permitting pivotal and sliding adjustment of said lip members relative to said brackets.

3. The pool of claim 2 in which said first opening is circular and in which such pool further comprises a cover fastened at each post location over said brackets.

* * * * *

UNITED STATES PATENT OFFICE

CERTIFICATE OF CORRECTION

Patent No. 4,062,158 Dated December 13, 1977

Inventor(s) Herbert O. Kaufmann

It is certified that error appears in the above-identified patent and that said Letters Patent are hereby corrected as shown below:

IN Claim 1, line 1, after "a" insert -- a plurality of attachment means for --.

Signed and Sealed this

Eighteenth Day of April 1978

[SEAL]

Attest:

RUTH C. MASON
Attesting Officer

LUTRELLE F. PARKER
Acting Commissioner of Patents and Trademarks